US005478295A

United States Patent [19]

Fracchia

[11] Patent Number: 5,478,295

[45] Date of Patent: Dec. 26, 1995

[54] APPARATUS AND METHOD OF INTERFACING AN EXERCISE MACHINE TO A COMPUTER

[76] Inventor: Kenneth H. Fracchia, 4325 Union Rd., Buffalo, N.Y. 14225

[21] Appl. No.: 984,225

[22] Filed: Nov. 30, 1992

[51] Int. Cl.[6] ..... A63B 23/035

[52] U.S. Cl. ..... 482/7; 482/3; 482/9; 482/51; 482/54; 482/57; 482/902; 482/8; 482/5

[58] Field of Search ..... 482/1–9, 51–54, 482/57, 900–903

[56] References Cited

U.S. PATENT DOCUMENTS

| | | | |
|---|---|---|---|
| 3,797,010 | 3/1974 | Adler et al. | 482/8 X |
| 4,408,613 | 10/1983 | Relyea | 482/5 X |
| 4,842,266 | 6/1989 | Sweeney, Sr. et al. | 482/54 |
| 4,911,427 | 3/1990 | Matsumoto et al. | 482/3 X |
| 5,149,084 | 9/1992 | Dalebout et al. | 482/3 |

*Primary Examiner*—Richard J. Apley
*Assistant Examiner*—Glenn E. Richman

[57] ABSTRACT

The invention interfaces a user-powered exercise machine to a personal computer, creating a dual-mode exercise and training system with new methods of pacing ones activity in order to achieve a goal. The user determines when the exercise period will end, and sets a goal. The computer constantly displays THE REQUIRED SPEED, which is the speed that will enable the user to achieve his goal. The CALCULATED FINAL OUTCOME predicts the outcome of the exercise period, assuming that the user will continue at his current speed for the remainder of the exercise period. The user always knows how fast he will have to go to reach his goal, and always knows what the outcome will be if he maintains his current speed. This allows the user to vary his speed and still maintain a regulated overall level of activity. In the STANDARD MODE, the exercise period is a period of time, and the goal is a TARGET DISTANCE. In the TRAINING MODE, the exercise period ends when the end of the course is reached, and the goal is a TARGET TIME. The invention includes a means of calculating heartbeat rate of depressing a key on the computer keyboard at a rate proportional to the user's pulse rate. The pulse data can be used to determine a goal which will produce a beneficial heartbeat rate, and the pulse data can be recorded to compare the heartbeat recovery rate from previous exercise periods. The invention can be calibrated by changing the number of exercise machine cycles required to travel one mile.

6 Claims, 5 Drawing Sheets

REQUIRED SPEED AND CALCULATED FINAL OUTCOME IN STANDARD MODE

REQUIRED SPEED AND CALCULATED FINAL OUTCOME IN TRAINING MODE

ELAPSED TIME 00 : 05 : 12

EXERCISE PERIOD 00 : 30 : 00

| REQUIRED SPEED | CURRENT SPEED |
|---|---|
| 12.169 | 10.486 |

CALCULATED FINAL DISTANCE. . . . . 5.429
TARGET DISTANCE. . . . . 6.125
DISTANCE TRAVELED. . . . . 1.095

Fig. 3

DISTANCE TRAVELED 0.471

COURSE LENGTH 6.138

| REQUIRED SPEED | CURRENT SPEED |
|---|---|
| 12.071 | 16.616 |

CALCULATED FINISH TIME. . . . . 00 : 22 : 30
TARGET TIME. . . . . 00 : 30 : 12
ELAPSED TIME. . . . . 00 : 02 : 02

Fig. 4

APPARATUS AND METHOD OF INTERFACING AN EXERCISE MACHINE TO A COMPUTER

FIELD OF THE INVENTION

There is an abundance of literature available pertaining to the physical benefits of exercise. In particular, it has been proven that exercises designed to elevate the heartbeat rate for a period of time provide the best cardiovascular benefits. There is a wide range of heartbeat rates which are beneficial. A person who is just starting an exercise program should exercise at a minimum heartbeat rate of 150 minus his age. This rate is the low end of the useful range of heartbeat rates. The high end of the range of useful rates is 200 minus your age. There are no further benefits obtained by increasing the rate above 200 minus your age.

A simple analysis of these two rates shows us that there is a wide range of beneficial heartbeat rates. If this range of rates was much more narrow, it would be necessary to monitor ones heartbeat rate during exercise for the purpose of regulating the level of activity to maintain a beneficial rate. However, since the beneficial range is not extremely narrow, one can easily stay within a beneficial range by pacing his activity to achieve a specific goal during the exercise period. The only need for a display of pulse rate is to help the user determine a goal which will motivate him to exercise at a beneficial energy level, and to enable the user to analyze his heartbeat recovery rate, which is an indicator of ones cardiovascular conditioning.

Both methods, pulse monitoring and pacing, have drawbacks. To monitor pulse rate while exercising, a sensor is attached to a part of the body, and the sensor is wired to an electronic device. If the sensor is on the users finger, arm motion is restricted. A wire dangling from any part of the body is an inconvenience. The pacing method can be boring. For a pacing method to be motivational it must allow the user to vary the level of activity throughout the exercise period, and it must encourage the user to achieve a goal, thereby maintaining a cardiovascular beneficial overall level of activity.

SUMMARY OF THE INVENTION

The object of the invention is to interface an exercise machine to a computer. The invention utilized the power of a personal computer to create a calibratable dual mode exercising and training system, with new methods of pacing ones exercise level to achieve a goal. THE REQUIRED SPEED informs the user of the speed needed to achieve a goal, and THE CALCULATED FINAL OUTCOME of the exercise period is constantly displayed, based on the current speed. In addition to these new means of pacing, the invention includes a means of calculating heartbeat rate by depressing a key on the computer keyboard at a rate proportional to the users pulse. The pulse calculator can be used to determine a goal which will product a beneficial heartbeat rate, and it can be used to compare the heartbeat recovery rate with the recovery rate from previous exercise sessions. Also, data related to the exercise period and pulse rate after exercising can be recorded for future reference.

BRIEF DESCRIPTION OF THE DRAWINGS AND APPENDIX

FIG. 3 is a non-graphic display screen in the STANDARD MODE, and FIG. 4 is a non-graphic display screen in the TRAINING MODE.

DETAILED DESCRIPTION OF THE INVENTION

Figures 1, 1A:
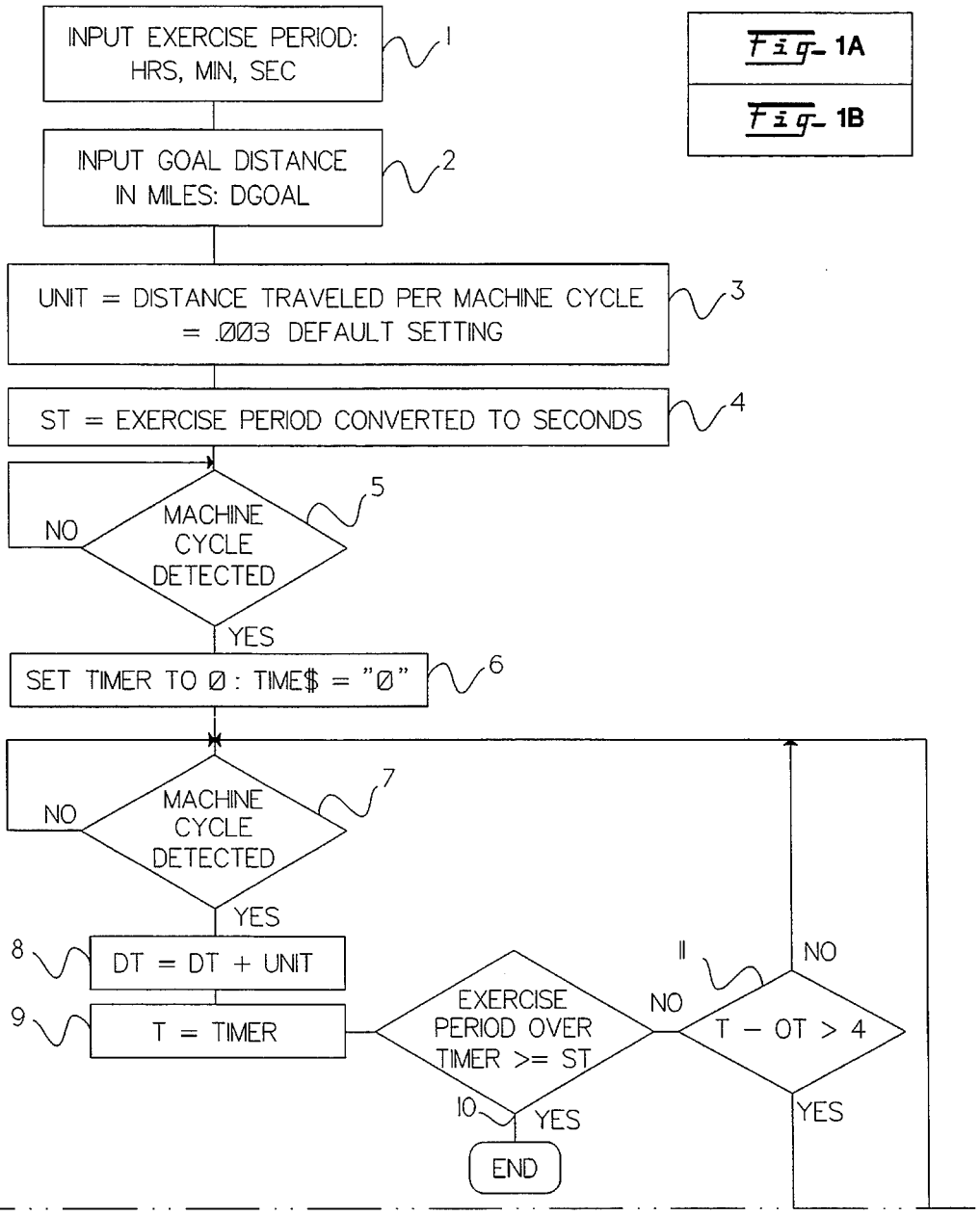
FIG. 1 shows in flowchart form, steps which a computer could follow to calculate and display the REQUIRED SPEED, THE CALCULATED FINAL OUTCOME, and related information, in the STANDARD MODE, where the exercise period is a period of time.

The invention comprises tow new methods of pacing using (1) the REQUIRED SPEED and (2) the CALCULATED FINAL OUTCOME. The REQUIRED SPEED is the minimum speed which, if maintained for the remainder of the exercise period, will enable the user to achieve his goal. The CALCULATED FINAL OUTCOME is a calculation of what the user will accomplish if the current speed is continued for the remainder of the exercise period.

STANDARD MODE

In the STANDARD MODE, the user sets a time limit 1 which determines the end of the exercise period 10. In order to maintain a vigorous level of activity, a goal 2, which will be referred to as THE TARGET DISTANCE, is also set, the objective being to have traveled a distance of at least the target distance as the exercise period ends. The distance actually traveled at the end of the exercise period is THE FINAL OUTCOME of the exercise period. The REQUIRED SPEED informs the user of the minimum speed which, if maintained for the remainder of the exercise period, will enable him to travel at least the target distance as the exercise period ends. This required speed is not a constant speed, and it changes to reflect ones progress. If you exercise at the current required speed as you approach the end of the exercise period, you will reach the target distance as the exercise period ends.

The CALCULATED FINAL OUTCOME, in this case the CALCULATED FINAL DISTANCE, is the distance you will reach at the end of the exercise period if you continue at your current speed for the remainder of the exercise period. By adjusting your speed so the calculated final distance equals or exceeds the target distance, and continuing at this adjusted speed for the remainder of the exercise period, you will equal or beat the target distance.

TRAINING MODE

In the TRAINING MODE, we are simulating an actual course. Therefore, the user sets a course length 21. When the COURSE LENGTH 21 is reached, the exercise period is ended 24, regardless of the time in which the course was completed. Therefore, when we use the phrase EXERCISE PERIOD in training mode, we are referring to a period of time which terminates when the user reaches the end of the course, and the actual time it takes to finish the course is the FINAL OUTCOME of the exercise period. The user sets a goal 22, referred to as the TARGET TIME, the objective being to have a timer reading equal to or less than the target time when the exercise period ends. In training mode, the REQUIRED SPEED informs the user of the minimum speed which, if maintained for the remainder of the exercise period, will result in a timer reading equal to or less than the target time at the end of the course. By exercising at the required speed as you approach the finish line, the exercise period will end at the target time.

The calculated final outcome, or CALCULATED FINISH TIME in training mode, is the total time it will take to finish the course if the current speed is maintained for the remainder of the exercise period. If the user adjusts his speed to make the calculated finish time equal to or less than the target time, and continues at this adjusted speed for the remainder of the exercise period, he will cross the finish line at or before the target time.

If only one of the two pacing methods is being used, the REQUIRED SPEED is preferred over the CALCULATED FINAL OUTCOME. The best method is to use both pacing methods together. The REQUIRED SPEED can be used as the primary pacing method. If the user achieves his goal before the exercise period ends, then he can use the CALCULATED FINAL OUTCOME method to aim for another goal, perhaps to beat his best previous final outcome.

In the event that these methods are used with a computer with limited display means, instead of displaying the CALCULATED FINAL OUTCOME along with the GOAL, the difference between these two values can be displayed, along with an indication of whether the CALCULATED FINAL OUTCOME is more or less than the GOAL. The preferred computer should be able to display all the suggested display material simultaneously. The invention can be used with any exercise machine where the amount of motion simulates distance traveled and the rate of said motion simulates speed. Also, any system using the described pacing method or methods can be equated to the invention. The sensor or sensors used to detect motion can be any sensor which can be interfaced to the computer being used, preferably using a standardized interface. The computer program can be modified to respond to more than one sensor, the number of sensors being limited by the computer's ability to perform the required functions several times during each cycle of the exercise machine.

The invention uses a computer means of calculating the previously defined values, as well as the following values. All values should be displayed right after they are calculated.

The ELAPSED TIME can be based on the computer's TIME$ function, which is set to zero 6 at the start of the exercise period. The distance traveled can be based on the number of sensor readings, using the formula (1/PRM) * (1/N) to represent the distance traveled from one sensor reading to the next, where PRM is the number of exercise machine cycles per unit of distance, a user entered number, and N is the number of times a sensor is triggered during one cycle of the exercise machine. The distance traveled 8 should be calculated at each sensor reading 7, and the unit of distance is determined by the user. For an exercise bike, the preferred units of distance are the mile or kilometer. The CURRENT SPEED can be calculated 13 using the formula (3600*MPS), MPS 12 being equal to (DT-OD)/(T-OT), where OT 16 is the value of TIMER when a sensor was previously triggered, OD 17 is the distance travelled at OT, T 9 is the value of TIMER at the first sensor reading to occur after 4 seconds 11 from OT, and DT 8 is the distance traveled at time T. The resulting CURRENT SPEED is in units of distance per hour. Calculating the CURRENT SPEED over a minimum time period of 4 seconds provides a stable display reading when exercising at a constant speed. This benefit outweighs the slight lag time of the display when accelerating or decelerating. The following values should be calculated each time the CURRENT SPEED is calculated.

In the STANDARD MODE, the REQUIRED SPEED can be calculated 14 using the formula 3600 *(DGOAL - DT)/(ST-TIMER), where DGOAL 2 is the user entered TARGET DISTANCE, DT is the same as in the CURRENT SPEED calculation, ST is the total number of seconds in the exercise period, and TIMER is the current value of TIMER. In the TRAINING MODE, the REQUIRED SPEED can be calculated 18 using the formula 3600 * (CL-DT)/(GS-TIMER), where CL is the user entered COURSE LENGTH 21, DT has the same value it had in the CURRENT SPEED calculation, GS 23 is the user entered TARGET TIME 22 in seconds, and TIMER is the current value of the TIMER function.

The REQUIRED SPEED should be set to zero if the goal is achieved during the exercise period, and there should be some indication if the required speed is faster than the user could possibly travel. In the STANDARD MODE, the CALCULATED FINAL DISTANCE can be determined 15 by using the formula DT+((ST-TIMER) * MPS), where DT has the same value it had in the CURRENT SPEED calculations, ST is the total number of seconds 4 in the EXERCISE PERIOD 1, TIMER is the current value of the TIMER function, and MPS has the same value as it had when the CURRENT SPEED was calculated. In the TRAINING MODE, the CALCULATED FINISH TIME in seconds can be calculated using the formula 19, TIMER+((CL-DT)/MPS), where TIMER is the current value of the TIMER function, CL is the user entered COURSE LENGTH 21, DT has the same value as in the CURRENT SPEED calculation, and MPS has the same value as it had in the CURRENT SPEED calculation. The calculated number of seconds is then converted 20 to hours, minutes, and seconds. After the exercise period is completed, the AVERAGE SPEED can be calculated using the formula 3600*DT/ST, where DT is the final distance travelled and ST was the length of the exercise period in seconds.

DISPLAY FORMAT

Figure 1B:
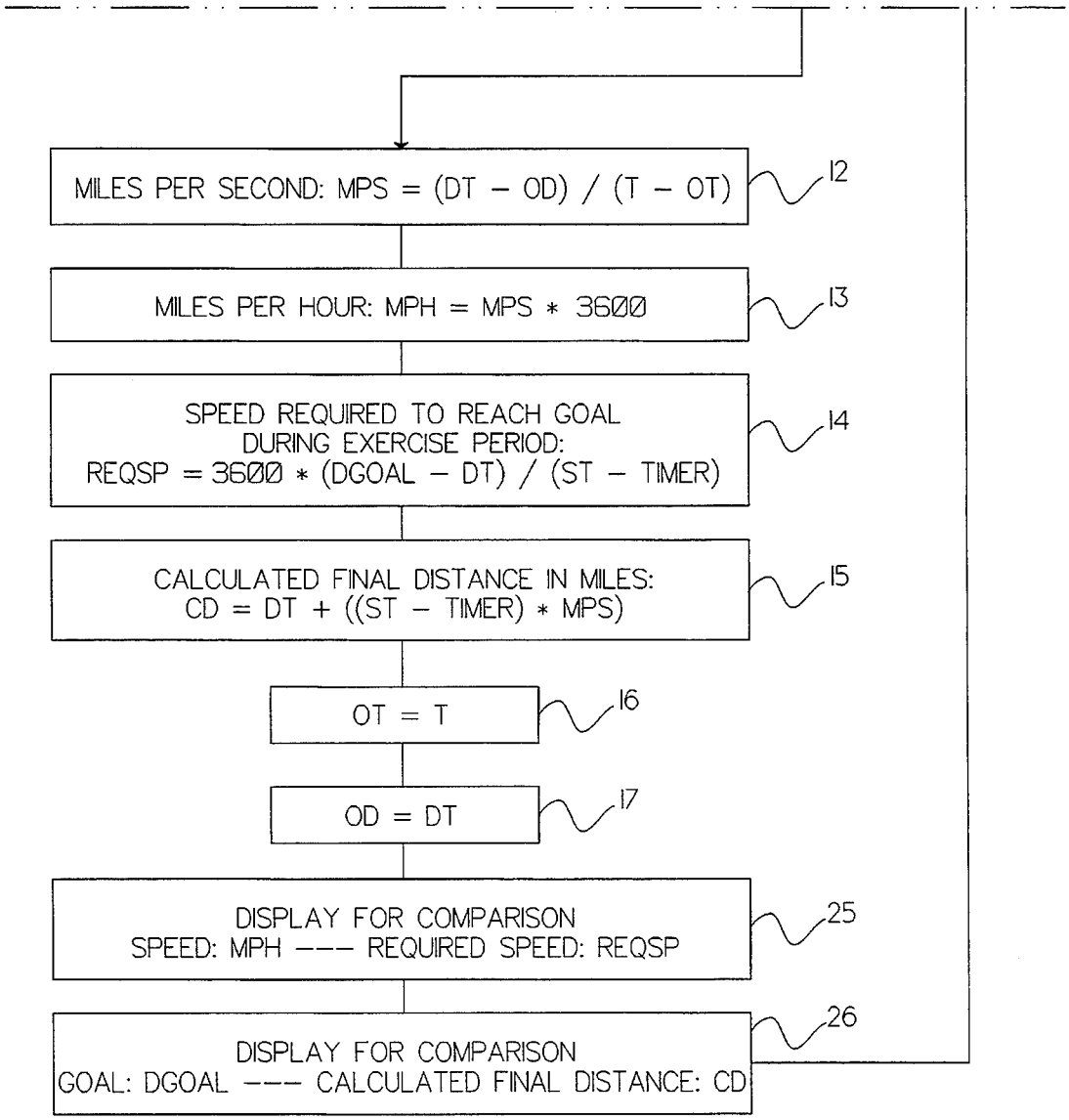

In the standard mode, the elapsed time and the length of the exercise period, both expressed in hours, minutes, and seconds, should be displayed in the upper area of the screen. The current speed and the required speed should be near the center of the screen, and the distance traveled, calculated final distance, and target distance should be displayed in the lower portion of the screen. (See FIG. 3 and FIG. 1*b*, references 25 and 26).

Figure 2A:
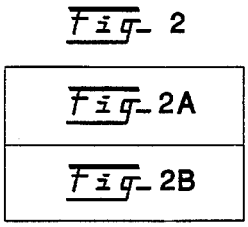
FIG. 2 shows, in flowchart form, steps which a computer could follow to calculate and display THE REQUIRED SPEED, THE CALCULATED FINAL OUTCOME, and related information, in the TRAINING MODE, where the exercise period ends when a course length is reached.
Figure 2A:
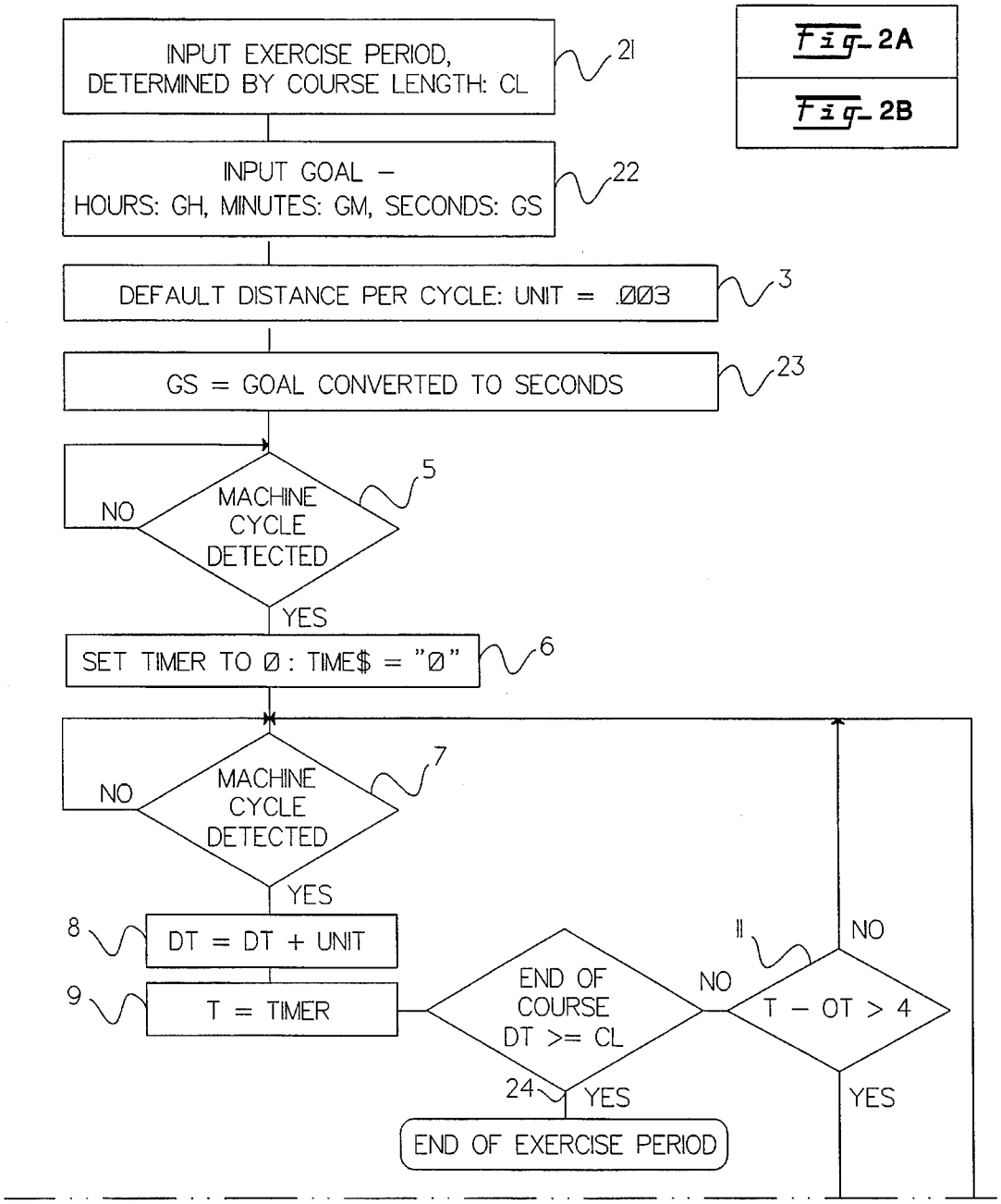
Figure 2B:
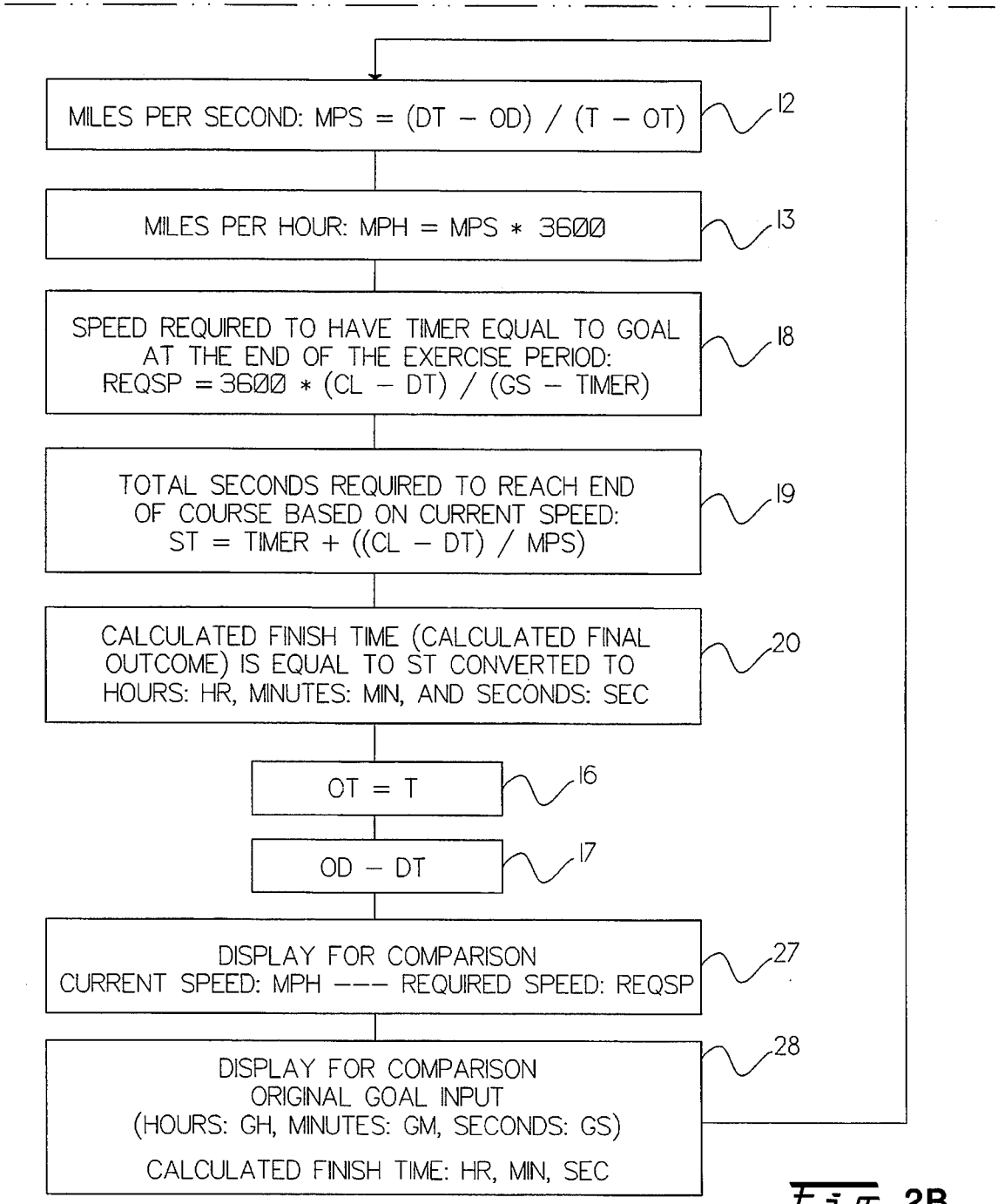

In the training mode, the distance traveled and the course length should be displayed in the upper area of the screen. The current speed and the required speed should be near the center of the screen, and the elapsed time, calculated finish time, and target time should be in the lower area of the screen. (See FIG. 4 and FIG. 2*b* references 27 and 28).

HEARTBEAT CALCULATOR

A heartbeat calculator program should be used to determine the level of activity needed to raise the pulse rate to the desired level. The heartbeat rate can be determined by analyzing key depressions on the computer keyboard, said depressions being performed by the user at the time of every third heartbeat. The pulse can be calculated using the time period between the last 12 heartbeats, which equates to the time between one keyboard depression and the fourth following depression. This method causes only a six second wait for the first pulse calculation if the user's pulse rate is 120 beats per minute.

The pulse rate can be calculated using the formula 720/(A(5)-A(1)), where A(1) is the value of the timer function when a key was depressed, and A(5) was the value of the timer function at the fourth keyboard depression after A(1). This calculation, occurring every third heartbeat since each keyboard depression represents three heartbeats, provides data for the array called PULSE(TIMER), where the value assigned to PULSE(TIMER) is the calculated pulse rate when the TIMER function was at TIMER seconds. The program should store this data and provide a means for displaying or printing the data for all previous exercise periods to the extent that the computer storage device can hold the information. Visual inspection or computer calculations based on the stored data can show how quickly the pulse rate drops. For example, you can compare how long it takes to drop from 120 BPM to 110 BPM. A reduction in this time period indicates an improved cardiovascular condition. If the first few heartbeat rates displayed are not within the range of your desired beneficial rate, then change the goal for the next exercise period accordingly.

CALIBRATION

Calibration of the system is performed by changing the number of exercise machine cycles per unit of distance. For example, assume you are using an exercise bike, and you enter 333 as the number of pedal revolutions per mile. Then the distance traveled per pedal revolution, based on the formula (1/PRM), where PRM is the number of pedal revolutions per mile, would be 0.003 miles 3. Many exercises bikes on the market today travel at this rate. By entering a lower number of pedal revolutions per mile, the distance traveled per pedal revolution will increase, and a higher number of revolutions per mile will decrease the distance traveled per pedal revolution. If the number of pedal revolutions per unit of distance is changed, there will be an inversely proportional change of distance travelled per pedal revolution, causing a change in the results of all calculations which involve distance traveled.

The preferred embodiment of the invention comprises means for performing the following tasks:

Task 1. Provide the option of displaying data from past exercise sessions, such data comprising the date of the exercise, length of period in hours, minutes, and seconds, average speed, pedal revolutions per mile, and pulse data.

Task 2. Direct the user to enter all user input values, using values from the previous session as the default values. These values comprise of the exercise mode, length of the exercise period, a goal, and the number of exercise machine cycles per mile.

Task 3. Delay starting the exercise period until motion of the exercise machine is detected 5.

Task 4. Allow the user to start the pulse calculator after exercising by depressing a specific key on the computer keyboard.

Task 5. In the event that the pulse calculator is used, the program should monitor the pulse rate for a period of at least one minute, and store the relevant exercise and pulse data recited in task 1.

Task 6. Allow the user to add data to the storage device used for task 1.

The appendix shows an example of a computer program, written in Microsoft QuickBASIC, which meets the requirements of the invention as described. Using QuickBASIC, the program as listed can be compiled into a form that can be executed directly from DOS. A file called DEFAULT.DAT must be recorded and must be accessible by the computer program. DEFAULT.DAT contains default input values. Before running the program, use the appropriate computer command, or a word processing program, to create the default file. An appropriate default file can contain the following values in the order shown: "0,30,0,333,7,7,0,30, 0,333, E". The values in this default file will change if you input any values different from the current default values. You are given the option of recording exercise and pulse data after the exercise period ends. Once you choose to record this data, the program creates a file called STORE.DAT to save the data. Saved data is added to the STORE.DAT file, and the program allows the data to be displayed before an exercise period.

APPENDIX

COPYRIGHT 1992 KENNETH FRACCHIA

```
REM EXERCISE.BAS
DIM PULSE(81),A(5)
   START:
CLEAR
WIDTH 40
CLS
LOCATE 5,1
PRINT "      DO YOU WISH TO REVIEW DATA"
PRINT "      FROM PREVIOUS EXERCISES ?"
INPUT "              (Y OR N)";X$
     IF X$="Y" THEN GOSUB REVIEWDATA
CLEAR
      GOSUB DEFAULTDATA
CLS
WIDTH 40
LOCATE 4,11:PRINT "(DEFAULT MODE- ";MODE$;")"
LOCATE 3,1:INPUT "EXERCISE OR TRAINING MODE (E OR T) ";CHMODE$
IF LEN(CHMODE$)>0 THEN MODE$=CHMODE$:WR=1

   IF MODE$ = "E" THEN
       GOSUB EMODEINPUT
       GOSUB WRDEFAULT
       GOSUB DELAYEDSTART
       GOSUB EXERCISEMODE
   END IF
```

```
IF MODE$ = "T" THEN
    GOSUB TMODEINPUT
    GOSUB WRDEFAULT
    GOSUB DELAYEDSTART
    GOSUB TMODE
END IF

GOSUB PULSE
GOTO START

EXERCISEMODE:
CLS: LET DT=0
LOCATE 5,16:PRINT USING "##";HRS;:PRINT ":";
PRINT USING "##";MIN;:PRINT ":";:PRINT USING "##";SEC
LOCATE 9,4:PRINT "REQUIRED SPEED     CURRENT SPEED"
LOCATE 20,3:PRINT "DISTANCE"
LOCATE 16,3:PRINT "CALCULATED FINAL DISTANCE"
LOCATE 18,3:PRINT "TARGET DISTANCE"
LOCATE 18,30:PRINT USING "####.###";DGOAL

TIME$="0"
X=0
UNIT = 1/PRM
ST=3600*HRS+60*MIN+SEC
    PEDALREVOLUTIONS:
ON STRIG(0) GOSUB CALCULATIONS
STRIG(0)ON
LOCATE 3,16:PRINT TIME$
```

```
    IF TIMER >= ST THEN
       STRIG(0)OFF
       AVSP=3600*DT/ST
       RETURN
    END IF
GOTO PEDALREVOLUTIONS
  CALCULATIONS:
   STRIG(0)OFF
   IF TIMER-X<.2 THEN LET X=TIMER:RETURN
   LET T = TIMER
  LET DT=DT+UNIT
   IF T-OT>4 THEN
  MPS=(DT-OD)/(T-OT)
  RS=ST-TIMER
  CD=DT+RS*MPS
  RD=DGOAL-DT
  REQSP=RD/RS*3600
  IF REQSP<0 THEN REQSP=0
  IF REQSP>100 THEN REQSP=0
LOCATE 11,23:PRINT USING "###.###";3600*MPS
LOCATE 16,30:PRINT USING "####.###":CD
LOCATE 11,10:PRINT USING "###.###";REQSP
  OD=DT:OT=T
   END IF
LOCATE 20,30:PRINT USING "####.###";DT
  LOCATE 3,16
  LET X = TIMER
       RETURN
```

```
        TMODE:
CLS
LOCATE 3,7:PRINT "DISTANCE TRAVELED"
LOCATE 5,11:PRINT "COURSE LENGTH":LOCATE 5,25:PRINT USING
"####.###";CL
LOCATE 9,4:PRINT "REQUIRED SPEED    CURRENT SPEED"
LOCATE 20,3:PRINT "TIMER"
LOCATE 16,3:PRINT "CALCULATED FINISH TIME"
LOCATE 18,3:PRINT "TARGET TIME"
LOCATE 18,27: PRINT USING "##";GH;
PRINT ":";
PRINT USING "##";GM;
PRINT ":";
PRINT USING "##";GS
    UNIT=1/TPRM
    GS=3600*GH+60*GM+GS
    X=0
    TIME$="0"
      TPEDREV:
    ON STRIG(0) GOSUB TCALC
    STRIG(0)ON
    LOCATE 20,27
    PRINT TIME$
    IF DT>=CL THEN
 STRIG(0)OFF
 AVSP = 3600*DT/ST
 RETURN
```

```
  END IF
GOTO TPEDREV
   TCALC:
   STRIG(0)OFF
   IF TIMER -X<.2 THEN X = TIMER:RETURN
   LET T = TIMER
   LET DT=DT+UNIT
IF T-OT>4 THEN
     MPS=(DT-OD)/(T-OT)
     RD=CL-DT
     RS=GS-TIMER
     REQSP=RD/RS*3600
     IF REQSP>100 THEN REQSP = 0
     IF REQSP<0 THEN REQSP = 0
     IF MPS <.0002 THEN GOTO SKIPCALC
     ST=TIMER+RD/MPS
     SKIPCALC:
     HR=ST\3600
     SEC=ST MOD 3600
     MIN=SEC\60
     SEC=SEC MOD 60
  LOCATE 11,24:PRINT USING "###.###";3600*MPS
  LOCATE 11,10:PRINT USING"###.###";REQSP
  LOCATE 16,27:PRINT USING "##";HR;
  PRINT ":";
  PRINT USING "##";MIN;
  PRINT ":";
  PRINT USING "##";SEC
```

```
    OD=DT
    OT=T
END IF
   LOCATE 3,25
   PRINT USING "####.###";DT
   LET X.= TIMER
   LOCATE 20,27
     RETURN

    PULSE:
  LOCATE 22,2:PRINT "PRESS P TO START THE PULSE CALCULATOR."
  IF INKEY$<>"P" THEN GOTO PULSE
  CHECKPULSE:
 CLS
 LOCATE 15,5:PRINT"DEPRESS A KEY ON EVERY THIRD HEARTBEAT,"
 LOCATE 17,10:PRINT"UNTIL THE BEEP SIGNAL."
 COUNTER= 1
 TIME$="0"
CHECKKEYBOARD:
 IF INKEY$ <> "" THEN GOTO PULSEC
 LOCATE 21,18
 PRINT USING "##";TIMER
 IF TIMER>80 THEN BEEP:GOTO STOREDATA
 GOTO CHECKKEYBOARD
   PULSEC:
 A(COUNTER)=TIMER
 IF COUNTER =5 THEN  GOTO PRINTARRANGEARRAY
 COUNTER = COUNTER + 1
```

```
  GOTO  CHECKKEYBOARD
PRINTARRANGEARRAY:
  LOCATE 23,18
  P=720/(A(5)-A(1))
  PRINT USING "###";P
  PULSE(TIMER)=P
  FOR X = 1 TO 4
  A(X)=A(X+1)
  NEXT X
  GOTO CHECKKEYBOARD

  STOREDATA:
OPEN "STORE.DAT" FOR APPEND AS #1
WRITE #1,DATE$,HRS,MIN,SEC,DT,AVSP
IF MODE$="E" THEN WRITE #1,PRM
IF MODE$="T" THEN WRITE #1,TPRM
FOR P = 1 TO 80
WRITE #1,PULSE(P)
NEXT P
CLOSE #1

REVIEWDATA:
    OPEN "STORE.DAT" FOR INPUT AS #1
 CONTREVIEW:
    INPUT #1,EXDATE$,HRS,MIN,SEC,DT,AVSP,PRM
 FOR P = 1 TO 80
 INPUT #1,PULSE(P)
 NEXT P
```

```
      WIDTH 80
  PRINT EXDATE$;"  ";HRS;":";MIN;":";SEC;"  ";
  PRINT "DISTANCE";:PRINT USING "###.###";DT;
  PRINT "   AVERAGE SPEED ";:PRINT USING "##.#";AVSP;
  PRINT "   PRM";PRM
  FOR P=1 TO 80
      IF PULSE(P)>0 THEN
   PRINT P;
   PRINT USING "###";PULSE(P);:PRINT,
      END IF
   NEXT P
   PRINT:PRINT
   IF EOF(1) THEN CLOSE #1:INPUT "PRESS ENTER KEY ",X$:RETURN
   GOTO CONTREVIEW
     EMODEINPUT:
WIDTH 40
LOCATE 7,1:PRINT "SET TIMER: HOW MANY HOURS (";HRS;")";:INPUT HRS$
LOCATE 9,5:PRINT "HOW MANY MINUTES (";MIN;")";:INPUT MIN$
LOCATE 11,5:PRINT "HOW MANY SECONDS (";SEC;")";:INPUT SEC$
IF LEN (HRS$)>0 THEN HRS=VAL (HRS$):WR=1
IF LEN (MIN$)>0 THEN MIN=VAL (MIN$):WR=1
IF LEN (SEC$)>0 THEN SEC=VAL (SEC$):WR=1
LOCATE 16,6:PRINT "TARGET DISTANCE (";DGOAL;")";
INPUT DGOAL$
IF LEN (DGOAL$)>0 THEN DGOAL=VAL (DGOAL$):WR=1
LOCATE 21,8:PRINT"(DEFAULT SETTING:";PRM;")"
LOCATE 20,1:INPUT "    PEDAL REVOLUTIONS PER MILE ";PRM$
IF LEN (PRM$)>0 THEN PRM=VAL (PRM$):WR=1
```

```
  RETURN

    TMODEINPUT:
LOCATE 7,8:PRINT "COURSE LENGTH  (";CL;")";:INPUT CL$
LOCATE 10,6:PRINT "WHAT IS THE TARGET TIME ?"
LOCATE 12,8: PRINT "HOW MANY HOURS (";GH;")";:INPUT GH$
LOCATE 14,7: PRINT "HOW MANY MINUTES (";GM;")";:INPUT GM$
LOCATE 16,7: PRINT "HOW MANY SECONDS (";GS;")";:INPUT GS$
LOCATE 20,7: PRINT "(DEFAULT SETTING:";TPRM;")"
LOCATE 19,1: INPUT "    PEDAL REVOLUTIONS PER MILE ";TPRM$
  IF LEN(CL$)>0 THEN CL=VAL(CL$):WR=1
  IF LEN(GH$)>0 THEN GH=VAL(GH$):WR=1
  IF LEN(GM$)>0 THEN GM=VAL(GM$):WR=1
  IF LEN(GS$)>0 THEN GS=VAL(GS$):WR=1
  IF LEN(TPRM$)>0 THEN TPRM=VAL(TPRM$):WR=1
    RETURN

DEFAULTDATA:
 OPEN "DEFAULT.DAT" FOR INPUT AS #1
 INPUT #1,HRS,MIN,SEC,PRM,DGOAL,CL,GH,GM,GS,TPRM,MODE$
 CLOSE #1
    RETURN

  WRDEFAULT:
IF WR=1 THEN
  OPEN "DEFAULT.DAT" FOR OUTPUT AS #1
  WRITE #1,HRS,MIN,SEC,PRM,DGOAL,CL,GH,GM,GS,TPRM,MODE$
  CLOSE #1
```

```
 END IF
    CLS
    LOCATE 21,10:PRINT"GET ON YOUR BIKE..."
    RETURN



   DELAYEDSTART:
  LET Z = 3
CYCLE:
  IF Z=-1 THEN RETURN


  ON STRIG(0) GOSUB COUNTREVOLUTIONS
  STRIG(0)ON
GOTO CYCLE
COUNTREVOLUTIONS:
   STRIG(0)OFF:IF TIMER-X<.2 THEN X=TIMER:RETURN
   LOCATE 10,19
   PRINT Z
   Z = Z-1
   X = TIMER
   RETURN
   END
```

I claim:

1. A method of providing information which can assist a person in achieving a goal during an exercise period, using an exercise machine in which the number of machine cycles simulates the distance traveled and the rate of said cycles simulates speed, and using a computer having a memory, means for inputting user-determined numerical data, a display screen, and means for detecting motion of said exercise machine, said method comprising the steps of:

(a) storing in said memory user-determined data, said data comprising an exercise period and a goal;

(b) continuously calculating the current rate of motion or speed during said exercise period;

(c) continuously calculating, during said exercise period or until said goal is achieved, which ever comes first, the rate of motion or speed, referred to as the required speed, which if continued for the remainder of said exercise period, would result in the achievement of said goal at the end of said exercise period; and (d) displaying on said screen said current speed and said required speed;

whereby, even if the rate of motion varies dramatically during said exercise period, said displayed information can be used to determine the speed required, during the remainder of said exercise period, to achieve said goal during said exercise period, and said required speed can be compared to said current speed.

2. The invention a cited in claim 1, where said goal is a target distance, said exercise period is a period of time, and said required speed is the speed which, if continued for the remainder of said exercise period, would result in reaching said target distance at the end of said time period, said required speed being equal to the current distance from said target distance, divided by the time remaining in said exercise period.

3. The invention as cited in claim 1, where said goal is a period of time or target time, said exercise period is represented by a distance or course length, and said required speed is the speed which, if continued for the remainder of said course, would result in the elapsed time being equal to said target time as the end of said course is reached, said required speed being equal to the current distance from the course length, divided by the difference between the current time and the target time.

4. A method of providing information which can assist a person in achieving a goal during an exercise period, using an exercise machine in which the number of machine cycles simulates the distance traveled and the rate of said cycles simulates speed, and using a computer having a memory, means for inputting user-determined numerical data, a display screen, and means for detecting motion of said exercise machine, said method comprising the steps of:

(a) storing in said memory user-determined data, said data comprising an exercise period and a goal (b) continuously calculating, during said exercise period, a predicted final outcome of said exercise period, said calculated final outcome being based on the continuation of the current speed for the remainder of said exercise period; and (c) displaying, along with said goal, said calculated final outcome;

whereby, the comparison of said goal to said calculated final outcome indicates whether the current speed is fast enough to achieve said goal during said exercise period, and said calculated final outcome indicates what the outcome will be if the current speed is continued for the remainder of said exercise period.

5. The invention as cited in claim 4, where said exercise period is a period of time, said goal is a target distance, and said calculated final outcome is a calculated final distance, where said calculated final distance is equal to the distance currently traveled, added to the time remaining in said exercise period multiplied by the current speed.

6. The invention as cited in claim 4, where said goal is a period of time, said exercise period is represented by a distance or course length, and said calculated final outcome is a calculated finish time, said calculated finish time being equal to the current elapsed time, added to the current distance form said course length divided by the current speed.

* * * * *

UNITED STATES PATENT AND TRADEMARK OFFICE

CERTIFICATE OF CORRECTION

PATENT NO. : 5,478,295

DATED : December 26, 1995

INVENTOR(S) : Kenneth H. Fracchia

It is certified that error appears in the above-indentified patent and that said Letters Patent is hereby corrected as shown below:

On the title page, item [57], 8th line before the end of the Abstract, change "of" to --by--.

Column 1, line 44, change "utilized" to --utilizes--.

Column 1, line 54, change "product" to --produce--.

Column 2, line 13, change "tow" to --two--.

Column 28, line 14, after "goal", insert --;--.

Column 27, line 29, change "a" to --as--.

Signed and Sealed this

Nineteenth Day of March, 1996

*Attest:*

Bruce Lehman

BRUCE LEHMAN

*Attesting Officer*

*Commissioner of Patents and Trademarks*